US012179257B2

(12) United States Patent
Kojima

(10) Patent No.: US 12,179,257 B2
(45) Date of Patent: Dec. 31, 2024

(54) MOLD FOR CONTINUOUS CASTING AND METHOD OF MANUFACTURING CONTINUOUS CASTING ROD

(71) Applicant: Resonac Corporation, Tokyo (JP)

(72) Inventor: Kouki Kojima, Kitakata (JP)

(73) Assignee: Resonac Corporation, Tokyo (JP)

( * ) Notice: Subject to any disclaimer, the term of this patent is extended or adjusted under 35 U.S.C. 154(b) by 0 days.

(21) Appl. No.: 18/211,972

(22) Filed: Jun. 20, 2023

(65) Prior Publication Data

US 2024/0001439 A1 Jan. 4, 2024

(30) Foreign Application Priority Data

Jul. 1, 2022 (JP) ..... 2022-107139

(51) Int. Cl.
*B22D 11/07* (2006.01)

(52) U.S. Cl.
CPC ..... *B22D 11/07* (2013.01)

(58) Field of Classification Search
CPC ..... B22D 11/07
See application file for complete search history.

(56) References Cited

U.S. PATENT DOCUMENTS 2,747,244 A * 5/1956 Goss ..... B22D 11/0401 164/268
4,598,763 A * 7/1986 Wagstaff ..... B22D 11/07 164/268
5,678,623 A * 10/1997 Steen ..... B22D 11/07 164/268

FOREIGN PATENT DOCUMENTS

CN 106925735 A * 7/2017 ..... B22D 11/003
CN 107377912 A * 11/2017 ..... B22D 11/003
CN 111069552 A * 4/2020
JP 08-501499 A 2/1996

* cited by examiner

*Primary Examiner* — Kevin E Yoon
(74) *Attorney, Agent, or Firm* — Sughrue Mion, PLLC

(57) ABSTRACT

A mold for continuous casting includes a cylindrical mold body with one end serving as a molten metal supply port and the other end serving as an ingot outlet, and a carbon ring arranged on the inner peripheral surface of the cylindrical mold body, wherein the carbon ring is configured by stacking a first ring member arranged on the one end side and a second ring member arranged on the other end side.

22 Claims, 5 Drawing Sheets

MOLD FOR CONTINUOUS CASTING AND METHOD OF MANUFACTURING CONTINUOUS CASTING ROD

BACKGROUND OF THE INVENTION

Field of the Invention

The present disclosure relates to a mold for continuous casting and a method of manufacturing a continuous casting rod.

Priority is claimed on Japanese Patent Application No. 2022-107139, filed Jul. 1, 2022, the content of which is incorporated herein by reference.

DESCRIPTION OF RELATED ART

Conventionally, continuous casting of aluminum or aluminum alloys has been carried out by horizontal continuous casting, vertical continuous casting, or the like, using a metal mold. In this continuous casting, molten metal such as an aluminum alloy is sent to the mold, the molten metal is cooled in the mold to solidify the surface of the molten metal, and cooling water is supplied to the surface of an ingot sent from the mold to solidify the inside of the ingot.

In metal molds, it is necessary to supply lubricant for casting to the contact portion between the mold and the molten metal in order to prevent seizure between the inner peripheral surface of the mold and the outer surface of the molten metal.

The vertical continuous casting apparatus of manufacturing aluminum alloy cast rods uses a metal mold is a metal mold. The lubricant is generally supplied through a graphite ring (a ring made of graphite) installed on the inner peripheral surface of a cylindrical metal mold as a method of supplying lubricant for casting (see, Patent Literature 1). In this method, lubricant (lubricating oil) is pressed into the pores formed in the graphite ring, and during casting, and the lubricant permeates into the contact area between the molten metal on the inner surface of the mold and the graphite ring. This supply method makes it possible to continuously and uniformly supply a very small amount of lubricant. At this time, gas may be introduced into the mold together with the lubricant.

However, in the conventional lubricant supply method using a graphite ring, it was necessary to replace the graphite ring periodically because the lubricant was carbonized and clogged in the graphite ring which became hot in repeated casting.

The present disclosure has been made in view of the above circumstances, and the present disclosure provides a mold for continuous casting that does not require periodic graphite ring replacement work, and a method for manufacturing a continuous casting rod using the mold.

CITATION LIST

Patent Literature

Patent Literature 1: Japanese Unexamined Patent Application. First Publication No. H08-501499

SUMMARY OF THE INVENTION

The present disclosure provides the following means to solve the above problems.

An aspect of the present disclosure provide a mold for continuous casting, including a cylindrical mold body with one end serving as a molten metal supply port and the other end serving as an ingot outlet, and a carbon ring arranged on the inner peripheral surface of the cylindrical mold body, wherein the carbon ring is configured by stacking a first ring member arranged on the one end side and a second ring member arranged on the other end side.

In the mold for continuous casting according to the above aspect, the mold body may include a lubricant supply path connected to the second ring member, and a gas supply path connected to the second ring member and arranged at a distance from the lubricant supply path, wherein a connecting portion connecting the lubricant supply path and the second ring member may be arranged closer to the first ring member than a connecting portion connecting the gas supply path and the second ring member.

In the mold for continuous casting according to the above aspect, the connecting portion connecting the lubricant supply path and the second ring member and the connecting portion connecting the lubricant supply path and the second ring member may be arranged to overlap each other when viewed from the direction connecting the one end and the other end.

In the mold for continuous casting according to the above aspect, the second ring member may be longer than the first ring member in the length in the direction connecting the one end and the other end.

In the mold for continuous casting according to the above aspect, of the first ring member and the second ring member, at least the second ring member may have a bulk density of 1.65 g/cm$^3$ to 1.9 g/cm$^3$ and may be made of a graphite material with a bending strength of 30 MPa to 98 MPa.

In the mold for continuous casting according to the above aspect, a groove configured for the lubricant supplied from the lubricant supply path to flow to the molten metal side may be formed in a surface of the second ring member that is stacked on the first ring member.

In the mold for continuous casting according to the above aspect, a lubricant flow groove, through which lubricant supplied from the lubricant supply path passes, may be formed along the inner peripheral surface in the second ring member.

In the mold for continuous casting according to the above aspect, a gas flow groove, through which a gas supplied from the gas supply path passes, may be formed along the inner peripheral surface in the second ring member.

An aspect of the present disclosure provide a method of manufacturing a continuous casting rod, wherein a continuous casting rod is manufactured using the mold for continuous casting.

In the method of manufacturing a continuous casting rod according to the above aspect, lubricant supply and gas supply may be independently controlled.

The mold for continuous casting according to the present disclosure can provide a mold for continuous casting which does not require periodic replacement work of graphite ring.

DETAILED DESCRIPTION OF THE INVENTION

While preferred embodiments of the disclosure have been described and illustrated above, it should be understood that these are exemplary of the disclosure and are not to be considered as limiting. Additions, omissions, substitutions, and other modifications can be made without departing from the scope of the present disclosure. Accordingly, the disclosure is not to be considered as being limited by the foregoing description, and is only limited by the scope of the appended claims,

[Mold for Continuous Casting]

Figure 1:
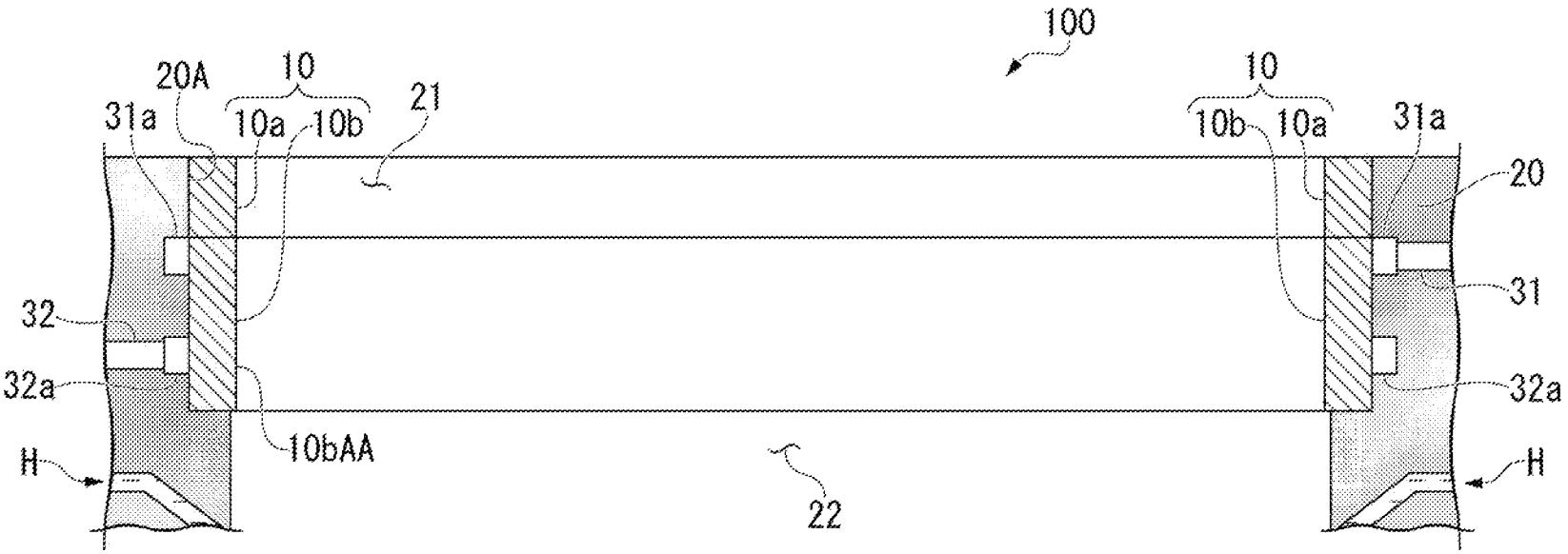
FIG. 1 is a schematic cross section of the continuous casting mold according to the present disclosure.
Figure 2:
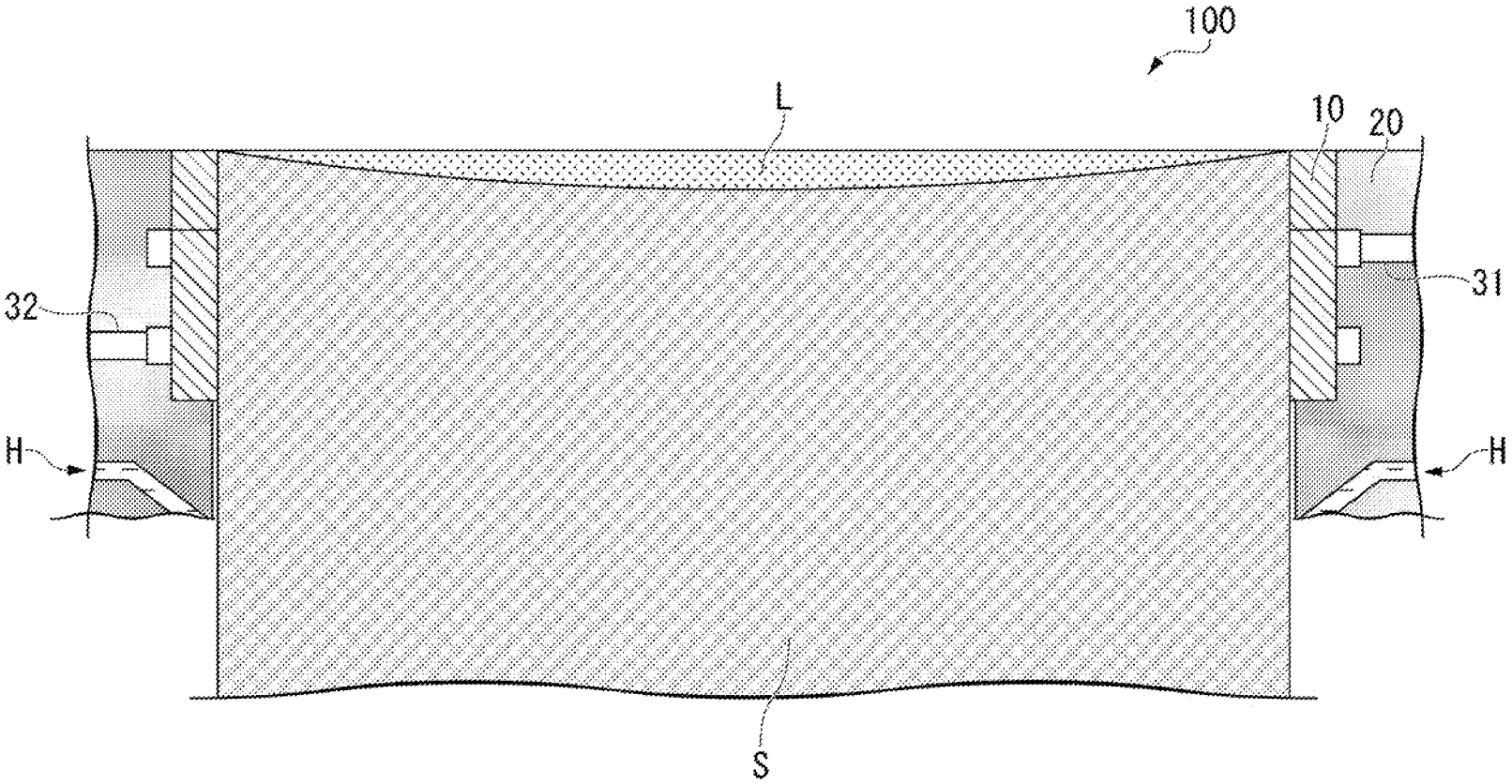
FIG. 2 is a diagram to illustrate the method of manufacturing a continuous casting rod using a vertical continuous casting apparatus equipped with the continuous casting mold shown in FIG. 1.
Figure 3:
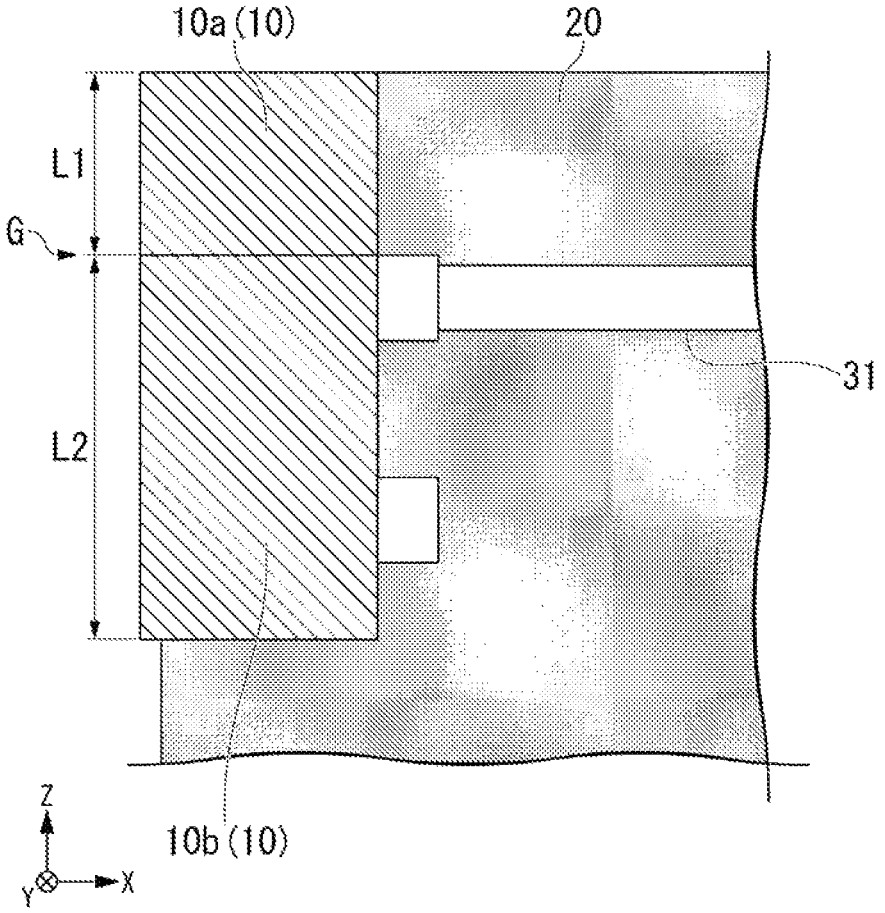
FIG. 3 is an enlarged schematic cross section of the vicinity of the carbon ring.

FIG. 1 shows a schematic cross section of the continuous casting mold according to the present disclosure. FIG. 2 is a diagram to illustrate the method of manufacturing a continuous casting rod using a vertical continuous casting apparatus equipped with the continuous casting mold shown in FIG. 1. FIG. 3 is an enlarged schematic cross section of the vicinity of the carbon ring.

A mold 100 for continuous casting shown in FIG. 1 is a mold used in continuous casting, includes a cylindrical mold body 20 with one end serving as a molten metal supply port 21 and the other end serving as an ingot outlet 22, and a carbon ring 10 arranged on the inner peripheral surface 20A of the mold body 20, wherein the carbon ring 10 is configured by stacking a first ring member 10*a* arranged on the one end side and a second ring member 10*b* arranged on the other end side.

In FIG. 1, the direction in which the first member 10*a* and the second member 10*b* stack (the direction connecting the one end described above and the other end described above) is defined as Z direction, the direction perpendicular to the Z direction and parallel to the paper surface is defined as X direction, and the direction perpendicular to the Z direction and perpendicular to the plane of paper is defined as the Y direction.

In the following, a carbon ring consisting of the first ring member and the second ring member is referred to as a 'divided carbon ring'.

A continuous casting apparatus equipped with a continuous casting mold 100 is a vertical continuous casting apparatus in which a molten metal L is supplied from the upper side of a cylindrical mold body 20 that opens in the vertical direction, and a solidified ingot S cooled by the supply of cooling water H is continuously drawn from the lower side of the mold body 20.

In a vertical continuous casting apparatus equipped with a continuous casting mold 100, for example, an aluminum alloy ingot S, such as an aluminum alloy slab (rectangular section) or an aluminum billet (circular section), can be used for continuous casting. The type of ingot S is not limited to the aluminum alloy mentioned above, but may be any metal that can be continuously casting using this vertical continuous casting apparatus.

The mold body 20 includes a lubricant supply path 31 connected to the second ring member 10*b*, and a gas supply path 32 connected to the second ring member 11*b* and arranged at a distance from the lubricant supply path 31. A connecting portion 31*a* connecting the lubricant supply path 31 and the second ring member 10*b* is arranged closer to the first ring member 10*a* than a connecting portion 32*a* connecting the gas supply path 32 and the second ring member 10*b* in the Z direction. Examples of the gas supplied front the gas supply path 32 include air, mixed gas (For example, oxygen and inert gas) and inert gas.

Since the lubricant supply path 31 supplying lubricant and the gas supply path 32 supplying the gas in the mold are arranged separately and do not share each other, the influence (interference, backflow, etc.) due to the pressure difference based on the supply amount of the lubricant and the gas can be prevented.

In addition, since the lubricant supply path 31 and the gas supply path 32 are independently provided, the supply amount of lubricant and gas can be independently controlled.

In the example shown in the figure, both the connection portion 31*a* and the connection portion 32*a* are arranged in the mold body 20 annularly along the outer peripheral surface of the annular carbon ring 10 (the second ring member 10*b*), but it is also possible that the lubricant supply path 31 is inserted into the second ring member 10*b* and the connection portion 31*a* is arranged in the carbon ring 10. Similarly, the gas supply path 32 may be inserted into the second ring member 10*b* and the connection portion 32*a* may be arranged in the carbon ring 10. One or both of the connection portions 31*a* and 32*a* may be arranged in the carbon ring 10.

In the example shown in the figure, the connection portion 31*a* and the connection portion 32*a* are arranged in the position that do not overlap each other when viewed from the Z direction, but they may be arranged so as to overlap.

A lubricant flow groove through which the lubricant supplied from the lubricant supply path 31 passes may be formed in the second ring member 10*b* in a surrounding shape. The surrounding shape can be one turn or less than one turn.

A gas flow groove through which the gas supplied from the gas supply path 32 passes may be formed in the second ring member 10*b* in a surrounding shape. The surrounding shape can be one turn or less than one turn.

In the Z direction, the connecting portion 31*a* connecting the lubricant supply path 31 and the second ring member 10*b* is arranged on the upper side of the second ring member 10*b*, and the connecting portion 32*a* connecting the gas supply path 32 and the second ring member 10*b* is arranged on the lower side of the second ring member 10*b*. For this configuration, the following effects are achieved.

Lubricant supplied from the lubricant supply path 31 descends by its own weight on the inner peripheral surface 10*b*AA of the second ring member 10*b* via the connecting portion 31*a*. On the other hand, gas supplied f-rom the gas supply path 32 is discharged from the inner peripheral surface 10*b*AA of the second ring member 10*b* via the connecting portion 32*a*, and gas is discharged on the wide surface of the second ring member 10*b* made of carbon by the effect of gas (air bubbling made denser by the porous of carbon material).

When gas is ejected in this state, the lubricant that descends by its own weight becomes a foamy lubricant, becomes an insulating layer near the molten metal contact surface of the mold, becomes a sealing layer of the supplied molten metal, and the molten metal becomes non-contact with the inner surface of the mold, so that a continuous casting rod with a smooth outer surface can be obtained. The synergistic effect also prevents primary cooling and thins the reverse segregation layer near the surface. Furthermore, there is no restriction on the type of oil because it does not penetrate the carbon ring 10 and is not discharged, and as long as it is not damaged, it is maintenance-free and can be used for a long time.

The carbon ring 10 is an annular member made of carbon. The carbon ring 10 is constructed by stacking a first ring member 10*a* and a second ring member 10*b*. As will be described in detail later, the lubricant sent from the lubricant supply path 31 is supplied to the inner peripheral surface of the mold through the gap G formed by stacking the first ring portion 10*a* and the second ring portion 10*b*. As described above, the carbon ring 10 does not have a structure in which the lubricant seeps out to the inner peripheral surface of the mold through the pores in the graphite material as in a conventional graphite ring. Therefore, it is not essential to have pores through which lubricant seeps as a material for the carbon ring 10. However, the lubricant may be made of material which seeps out to the inner peripheral surface of the mold, not only through the gap where the first ring member 10*a* and the second ring member 10*b* are stacked, but also through pores in the material as conventional graphite rings. In terms of heat resistance to molten metal, graphite is still preferred as the carbon material constituting the carbon ring 10, but it is not limited to this. The carbon ring 10 may also be manufactured by extruding fine graphite particles or pressing them together by hydrostatic pressure so as to have a predetermined pore structure.

There are no particular restrictions on how the carbon ring 10 can be attached to the mold body 20, and for example, it can be attached to the mold body 20 by baking and fitting using the difference in the thermal expansion coefficient between the mold body 20 and the carbon ring 10. Carbon has a smaller coefficient of thermal expansion than the metal composing the mold body 20. When the inner diameter of the mold body 20 is set smaller than the outer diameter of the carbon ring 10 at room temperature and the carbon ring 10 is fitted inside the mold body 20 whose inner diameter has been enlarged by heating, the carbon ring 10 is fixed in a state of being tightened to the mold body 20 due to the temperature drop of the mold 10. When the mold body 20 and the carbon ring 10 are attached by shrink fitting, the mold body 20 and the carbon ring 10 are in close contact and no gap is formed between them. Therefore, heat transfer from the carbon ring 10 to the mold body 20 is rapidly performed during continuous casting. In addition, since the mold body 20 and the carbon ring 10 adhere to each other in the entire circumferential area, cooling unevenness in the circumferential direction does not occur.

The carbon ring 10 has a configuration in which the first ring member 10*a* and the second ring member 10*b* are stacked (combined configuration). The first ring member 10*a* and the second ring member 10*b* may be carbon materials having the same properties, or may be carbon materials having different properties.

Of the first ring member 10*a* and the second ring member 10*b*, at least the second ring member 10*b* may have a bulk density of 1.65 g/cm$^3$ to 1.9 g/cm$^3$ and may be made of a graphite material with a bending strength of 30 MPa to 98 MPa. This is because the ring member made of a graphite material having such properties is sufficiently permeable to the gas supplied from the gas supply path 32 and has sufficient strength to be used for continuous casting of an aluminum alloy.

The carbon ring 10 may be configured by dividing an integral carbon ring into two parts, a first ring member 10*a* and a second ring member 10*b*.

In the carbon ring 10, as for the length in the Z direction, the length of the second ring member 10*b* (symbol L2 in FIG. 3) is longer than the length of the first ring member 10*a* (symbol L1 in FIG. 3).

Figure 4A:
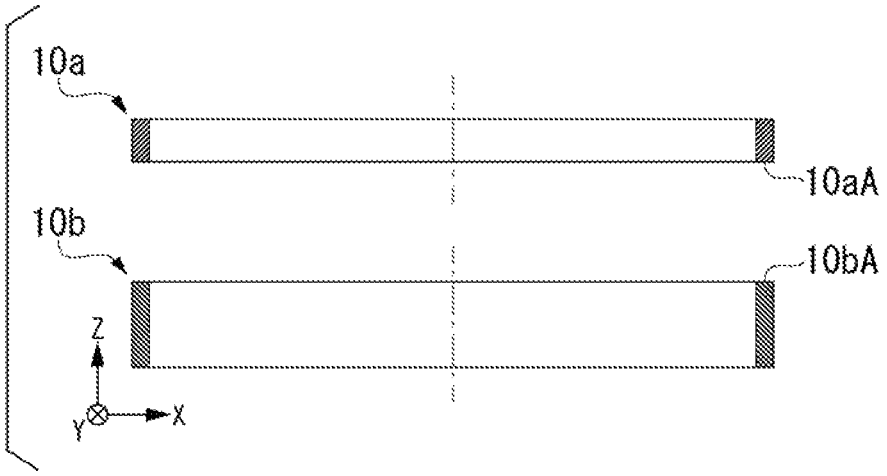
FIG. 4A is a schematic cross section showing the first ring member 10*a* and the second ring member 10*b* which constitute the carbon ring 10, separated from each other.

For convenience of explanation. FIG. 4A is a schematic cross section showing the first ring member 10*a* and the second ring member 10*b*, which constitute the carbon ring 10, separated from each other. As shown in FIG. 3, in the state of being fitted into the inner peripheral surface of the mold 20 for continuous casting, only a small gap G (see FIG. 3) is formed between the mating surfaces (stacking surfaces, overlapping surfaces) 10*a*A and 10*b*A of the first ring member 10*a* and the second ring member 10*b* according to the flatness of the respective mating surfaces. On the other hand, the mating surface 10*b*A of the second ring member 10*b* may have grooves or recesses (only three grooves or recesses of which are indicated by the symbol 10*ba*) through which the lubricant supplied from the lubricant supply path 31 passes to the molten side as shown in FIG. 4B.

Figure 4B:
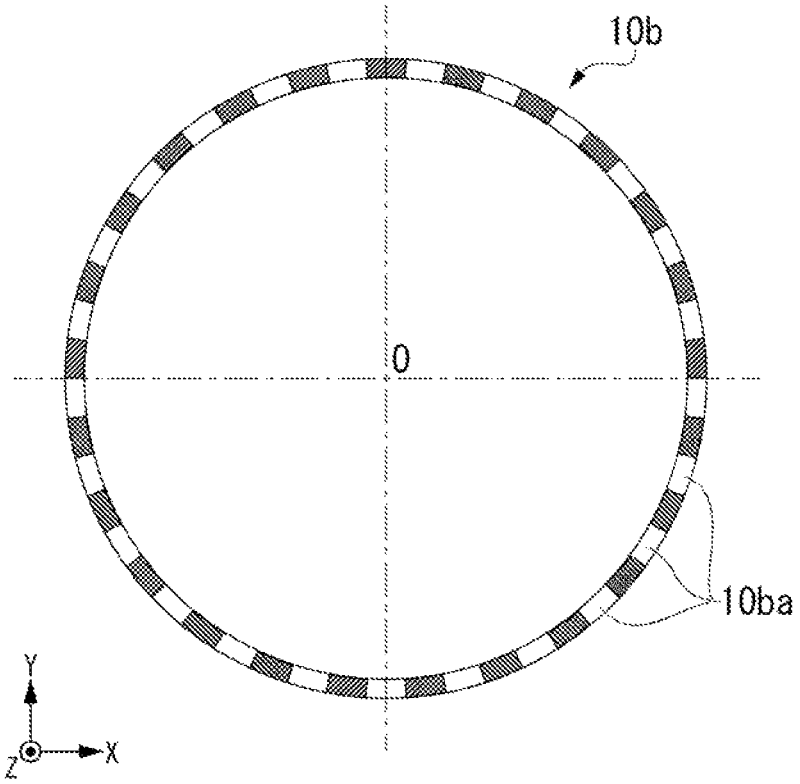
FIG. 4B is a schematic plan view of the second ring member 10*b*.

In the example shown in FIG. 4B, grooves with the center of the hollow facing O in plan view from the Z direction are formed at equal intervals, but the number of grooves is not limited to this, and some grooves may be unequally spaced, and all grooves may be unequally spaced. In view of the uniform supply of lubricant to the inner peripheral surface 20A of the mold body 20, it is preferable that the grooves are equally spaced. The depth of the groove Oba can be, for example, about 0.015 mm to 2 mm.

Figure 5:
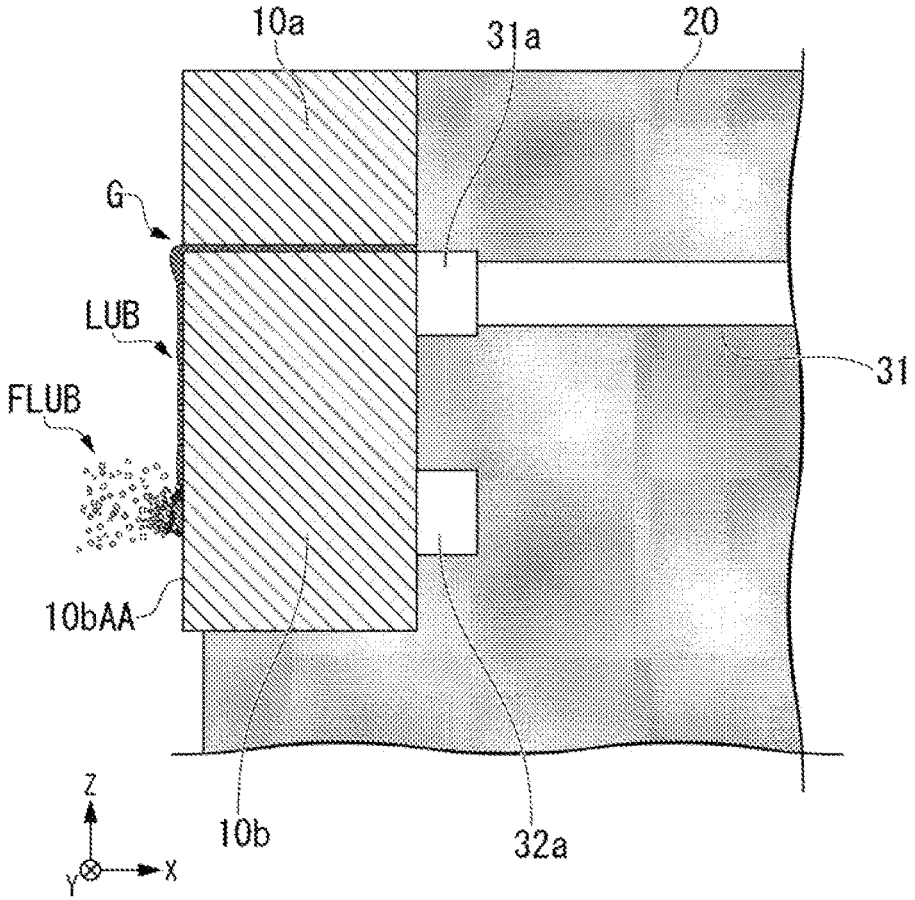
FIG. 5 is a conceptual illustration of the working effect of the continuous casting mold according to the present disclosure.

FIG. 5 shows a conceptual illustration of the working effect of the continuous casting mold according to the present disclosure.

In the continuous casting mold 100 shown in FIG. 1, in the Z direction, the connecting portion 31*a* connecting the lubricant supply path 31 and the second ring member 10*b* is arranged on the upper side of the second ring member 10*b*, and the connecting portion 32*a* connecting the gas supply path 32 and the second ring member 10*b* is arranged on the lower side of the second ring member 10*b*. The carbon ring 10 has a configuration in which the first ring member 10*a* and the second ring member 10*b* are stacked in the Z direction.

Lubricant supplied from the lubricant supply path 31 is supplied to the inner peripheral surface 10*b*AA of the second ring member 10*b* through the gap G between the first ring member 10*a* and the second ring member 10*b* via the connecting portion 31*a*. Lubricant LUB supplied to the inner peripheral surface 10*b*AA of the second ring member 10*b* descends the inner peripheral surface 10*b*AA by its own weight. On the other hand, the gas supplied from the gas supply path 32 is discharged from the inner peripheral surface 10*b*AA of the second ring member 10*b* via the connecting portion 32*a*, and the gas is discharged on the wide surface of the second ring member 10*b* by the air bubbling effect. By the discharge of gas in this state, the lubricant that descends by its own weight becomes a foamy lubricant FLUB, becomes an insulating layer near the molten metal contact surface of the mold, and by becoming a sealing layer of the supplied molten metal, the molten metal becomes non-contact with the inner surface of the mold, and a continuous casting rod with a smooth outer surface can be obtained.

Figure 6:
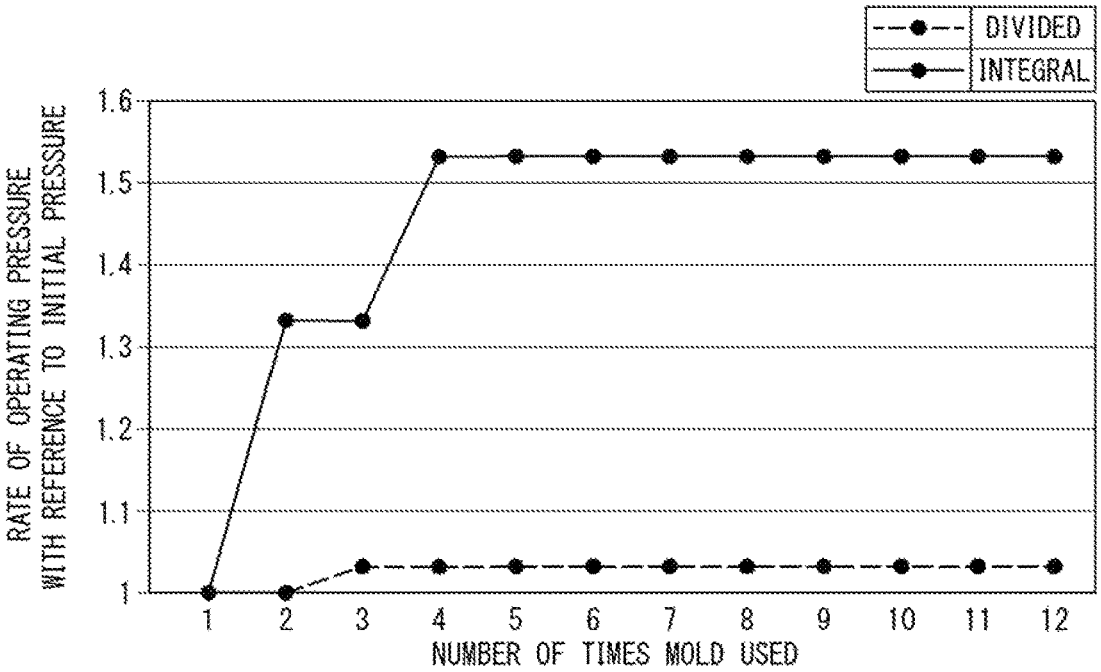
FIG. 6 is a graph comparing the transition of the pressure for lubricant supply according to the number of times the mold is used between the continuous casting mold with the divided carbon ring of the present disclosure and the continuous casting mold with the integral carbon ring.

FIG. 6 is a graph comparing the transition of the pressure for lubricant supply (lubricant pressure) according to the number of times the mold is used between the continuous casting mold with the divided carbon ring of the present disclosure and the continuous casting mold with the conventional integral carbon ring. The material of the carbon ring is graphite.

In the graph of FIG. 6, the horizontal axis is the number of times the mold is used (That is, the number of times continuous casting rods were manufactured), and the vertical axis is the ratio of the operating pressure at each number of times of use when the initial pressure of the lubricant pressure is 1.

Clogging is determined when the ratio of the working pressure to the initial pressure of the lubricant pressure is 1.5.

In the case of the conventional integral carbon ring, the lubricant pressure is above the pressure considered clogged in the fourth use, whereas in the case of the divided carbon ring, the lubricant pressure did not change even in the twelfth use after the ratio of the working pressure to the initial pressure increased to about 1.03 in the third use.

Thus, it can be seen that the clogging of the carbon ring is drastically reduced when the divided carbon ring according to the present disclosure is used as compared with the case when the conventional integral carbon ring is used.

<Method of Manufacturing Continuous Casting Rod>

The method of manufacturing a continuous casting rod according to the present disclosure can manufacture continuous casting rods using the continuous casting mold of the present disclosure described above.

In the production of a continuous casting rod using the continuous casting mold of the present disclosure, while introducing lubricant and gas between the molten metal L. and the carbon ring 10, the molten metal L receives primary cooling front the inner peripheral surface of the carbon ring 10, and solidification proceeds front the outer circumferential surface of the molten metal L, to the center, and the molten metal L descends and solidifies with the cooling water H to produce the continuous casting rod.

What is claimed is:

1. A mold for continuous casting, comprising:

a cylindrical mold body with one end serving as a molten metal supply port and the other end serving as an ingot outlet, and a carbon ring arranged on the inner peripheral surface of the cylindrical mold body, wherein the carbon ring is configured by stacking a first ring member arranged on the one end side and a second ring member arranged on the other end side, and wherein the mold body includes a lubricant supply path connected to the second ring member, and a gas supply path connected to the second ring member and arranged at a distance from the lubricant supply path.

2. The mold for continuous casting according to claim 1, wherein the mold body includes a lubricant supply path connected to the second ring member, and a gas supply path connected to the second ring member and arranged at a distance from the lubricant supply path, wherein a connecting portion connecting the lubricant supply path and the second ring member is arranged closer to the first ring member than a connecting portion connecting the gas supply path and the second ring member.

3. The mold for continuous casting according to claim 2, wherein the connecting portion connecting the lubricant supply path and the second ring member and the connecting portion connecting the lubricant supply path and the second ring member are arranged to overlap each other when viewed from the direction connecting the one end and the other end.

4. The mold for continuous casting according to claim 3, wherein the second ring member is longer than the first ring member in the length in the direction connecting the one end and the other end.

5. The mold for continuous casting according to claim 4, wherein, of the first ring member and the second ring member, at least the second ring member has a bulk density of 1.65 g/cm$^3$ to 1.9 g/cm$^3$ and is made of a graphite material with a bending strength of 30 MPa to 98 MPa.

6. The mold for continuous casting according to claim 3, wherein, of the first ring member and the second ring member, at least the second ring member has a bulk density of 1.65 g/cm$^3$ to 1.9 g/cm$^3$ and is made of a graphite material with a bending strength of 30 MPa to 98 MPa.

7. The mold for continuous casting according to claim 2, wherein the second ring member is longer than the first ring member in the length in the direction connecting the one end and the other end.

8. The mold for continuous casting according to claim 7, wherein, of the first ring member and the second ring member, at least the second ring member has a bulk density of 1.65 g/cm$^3$ to 1.9 g/cm$^3$ and is made of a graphite material with a bending strength of 30 MPa to 98 MPa.

9. The mold for continuous casting according to claim 2, wherein, of the first ring member and the second ring member, at least the second ring member has a bulk density of 1.65 g/cm$^3$ to 1.9 g/cm$^3$ and is made of a graphite material with a bending strength of 30 MPa to 98 MPa.

10. The mold for continuous casting according to claim 2, wherein a groove configured for the lubricant supplied from the lubricant supply path to flow to the molten metal side is formed in a surface of the second ring member that is stacked on the first ring member.

11. The mold for continuous casting according to claim 2, wherein a lubricant flow groove, through which lubricant supplied from the lubricant supply path passes, is formed along the inner peripheral surface in the second ring member.

12. The mold for continuous casting according to claim 2, wherein a gas flow groove, through which a gas supplied from the gas supply path passes, is formed along the inner peripheral surface in the second ring member.

13. The mold for continuous casting according to claim 1, wherein the second ring member is longer than the first ring member in the length in the direction connecting the one end and the other end.

14. The mold for continuous casting according to claim 13, wherein, of the first ring member and the second ring member, at least the second ring member has a bulk density of 1.65 g/cm$^3$ to 1.9 g/cm$^3$ and is made of a graphite material with a bending strength of 30 MPa to 98 MPa.

15. The mold for continuous casting according to claim 1, wherein, of the first ring member and the second ring member, at least the second ring member has a bulk density of 1.65 g/cm$^3$ to 1.9 g/cm$^3$ and is made of a graphite material with a bending strength of 30 MPa to 98 MPa.

16. A method of manufacturing a continuous casting rod, wherein a continuous casting rod is manufactured using the mold for continuous casting, comprising:

a cylindrical mold body with one end serving as a molten metal supply port and the other end serving as an ingot outlet, and a carbon ring arranged on the inner peripheral surface of the cylindrical mold body, wherein the carbon ring is configured by stacking a first ring member arranged on the one end side and a second ring member arranged on the other end side, and wherein the mold body includes a lubricant supply path connected to the second ring member, and a gas supply path connected to the second ring member and arranged at a distance from the lubricant supply path.

17. The method of manufacturing a continuous casting rod according to claim 16, wherein lubricant supply and gas supply are independently controlled.

18. The method of manufacturing a continuous casting rod according to claim 16, wherein a connecting portion connecting the lubricant supply path and the second ring member is arranged closer to the first ring member than a connecting portion connecting the gas supply path and the second ring member.

19. The method of manufacturing a continuous casting rod according to claim 16, wherein a gap formed the first ring member and the second ring member for supplying lubricant.

20. The method of manufacturing a continuous casting rod according to claim 16, wherein a groove configured for the lubricant supplied from the lubricant supply path to flow to the molten metal side is formed in a surface of the second ring member that is stacked on the first ring member.

21. The method of manufacturing a continuous casting rod according to claim 16, wherein a lubricant flow groove, through which lubricant supplied from the lubricant supply path passes, is formed along the inner peripheral surface in the second ring member.

22. The method of manufacturing a continuous casting rod according to claim 16, wherein a gas flow groove, through which a gas supplied from the gas supply path passes, is formed along the inner peripheral surface in the second ring member.

* * * * *